US006223876B1

(12) United States Patent
Walsh et al.

(10) Patent No.: US 6,223,876 B1
(45) **Date of Patent: *May 1, 2001**

(54) BANK NOTE VALIDATOR

(75) Inventors: Michael Walsh, East Patchogue; Miroslaw Blaszczec, Lindenhurst; Thomas W. Mazowiesky, Medford, all of NY (US)

(73) Assignee: Global Payment Technologies, Inc., Valley Stream, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/080,524

(22) Filed: May 18, 1998

Related U.S. Application Data

(63) Continuation of application No. 08/659,139, filed on Jun. 4, 1996, now abandoned.

(51) Int. Cl.[7] ..... G07D 7/00
(52) U.S. Cl. ..... 194/207; 250/556
(58) Field of Search ..... 194/207; 250/556; 356/71; 382/135

(56) References Cited

U.S. PATENT DOCUMENTS

| | | | | |
|---|---|---|---|---|
| 4,204,765 | * | 5/1980 | Iannadrea et al. | 250/556 X |
| 4,592,090 | * | 5/1986 | Curl et al. | 382/135 |
| 4,618,257 | * | 10/1986 | Bayne et al. | 356/71 |
| 4,881,268 | * | 11/1989 | Uchida et al. | 382/135 |
| 4,947,441 | * | 8/1990 | Hara et al. | 382/135 |
| 5,027,415 | * | 6/1991 | Hara et al. | 382/135 |
| 5,199,543 | * | 4/1993 | Kamagami et al. | 194/207 |
| 5,304,813 | * | 4/1994 | De Man | 250/556 |
| 5,367,577 | * | 11/1994 | Gotaas | 382/135 |
| 5,476,169 | * | 12/1995 | Takarada et al. | 194/207 |

FOREIGN PATENT DOCUMENTS

| | | | |
|---|---|---|---|
| 3239995 | * | 5/1984 | (DE) . |
| 605208 | * | 7/1994 | (EP) . |
| 660277 | * | 6/1995 | (EP) . |

* cited by examiner

*Primary Examiner*—F. J. Bartuska
(74) *Attorney, Agent, or Firm*—Finnegan, Henderson, Farabow, Garrett & Dunner L.L.P.

(57) ABSTRACT

A bank note detector has four LED's emitting Red, Green, Blue, and infrared light and a detector for sensing light reflected and transmitted from the bank note. The system includes microprocessor for analysis circuiting for selecting and adjusting the LED's, for programmable amplifying the light detected and feeding the amplified signal to the microprocessor.

11 Claims, 2 Drawing Sheets

BANK NOTE VALIDATOR

RELATED APPLICATIONS

The present application is a continuation of U.S. patent application Ser. No. 08/659,139, filed Jun. 4, 1996 now abandoned.

BACKGROUND OF THE INVENTION

The present invention relates generally to a bank note validator and more specifically to a bank note or document validator designed to distinguish between authentic notes and documents and counterfeit notes and documents.

Bank note validators have answered the call of the marketers, by providing the ability to facilitate high cost transactions mechanically. Bank note validators are most popular in the beverage vending, food vending, product vending, gaming and wagering businesses. Change machines, i.e. currency to coin facilitating beverage, phone, and many other transactions are popular. In addition, bank note or currency validators are also used to authenticate such other financial instruments as stocks, bonds, and security documents. Therefore, as used herein, the term "bank notes" or "notes" will encompass all such applications.

Validation techniques have been consistently foiled by the ability of individuals to replicate the features inherent to bank notes with engineered facsimiles. The casual counterfeiter has at his disposal a variety of tools which are sufficient in generating reasonable facsimiles to foil even the best currency validator. Black and white copy machines, color copy machines, fax machines, ink jet copiers, computers and scanners are all tools which may be used to foil the common bank note validator. Some of these methods are very detailed and complex, yet none utilize the exact chemistry found in engraving dyes and inks used in bank note printing.

By far the greatest advancement in the bank note validator has been with the implementation of optical systems. The optical devices have been used transmissively and reflectively. Optical systems are very good at analyzing currency since all bills are designed to be recognized on sight by humans. Many features such as watermarks, security threads, and colored threads inserted as counterfeit deterrents are detectable primarily by sight. Therefore, it is reasonable to understand why people have high expectations towards electronic vision systems. Unfortunately, the human model for counterfeit detection cannot be built electronically into bank note validation systems because the cost would be prohibitive. A common method employed is to measure the signal responses reflected or transmitted through the printed and non-printed areas on the surface of a bank note, utilizing common light sources and comparing the result with an image stored in the currency validator memory. Major difficulties are encountered with properly detecting the very new bank note and the degraded image resulting from the worn bank note, compounded by printing misregistrations, while rejecting the acceptance of counterfeits.

Systems incorporating spectral analysis can overcome the difficulty of rejecting valid bank notes, even if very new or worn. In the performance of spectral analysis, it is possible to characterize the reflective, transmissive and absorptive properties inherent in genuine bank notes with light of wavelengths narrowly focused between ultraviolet and infrared. It is possible to determine the chemical composition of bank notes, as is employed in scientific analysis of other chemical studies, and store the results in a database for comparison later. In fact, utilizing the strictly controlled "chemical signature" of bank notes would be just the thing for detecting frauds and counterfeits. However, to implement such a spectrum analyzer in the bank note validation system would be prohibitive in both terms of expense and time required to perform a scan of the full light spectrum for each point along the length of a bank note.

Current spectral analysis technology typically uses one or more optical sensors to detect the optical reflection and/or absorption characteristics of bank notes. Many systems incorporate emitters and detectors operating in two or more wavelengths. These units usually take several points in discrete paths or channels along the long axis of a bank note. By comparing the sampled results with pre-stored results from real bank notes a determination can be made as to the type and genuineness of the bank note. Thus, the spectral analysis approach is not necessarily a fine resolution type system relying on the printed image of the bank note. It is a system which relies on the "signature bands" of genuine bank notes as they are generated by the absorbance, reflectance and transmission of specific wavelengths of light.

Typically the emitter/detector pairs comprise at least one set of infrared sensitive units. This allows data to be taken for almost all currencies, regardless of the visible color of the bank note. However, a drawback to this method is that a two-tone copy (black and white) or a copy made on colored paper can be devised that will produce data that mimics a real bank note, causing a counterfeit bank note to be accepted as genuine. As color copy technology has improved, it has also become possible to produce color copies almost identical in the visual spectrum with real bank notes.

Many countries constantly change their currency to limit counterfeit bank notes, cut production costs, improve longevity, etc. Several countries use different width bank notes as well. These different widths are difficult to accommodate in a single validation unit since the data channel for the narrower bank notes will vary depending on the insertion location in the unit. This usually requires several databases to be developed for one denomination. During the validation process it is necessary to scan each of these databases in succession and then decide if a match is possible. This can result in a process that takes several seconds, annoying or worrying the user.

Since most currencies in the world use different color combinations on different denominations, a validator that can detect these colors would be able to select which database to use to compare with the bank note. This would reduce the processing time significantly since only one set of databases needs searching. Two-tone copies might be eliminated since there would be no color in the data collected. Copies printed on color paper could also be eliminated since the subtle color variations on real currency would be missing. By comparing the color data with infrared data, acceptance of color copies may be greatly reduced.

Typical systems to detect color utilize three sensors for the Red, Green and Blue portions of the visible spectrum and a white light to illuminate the object. White light sources that produce an even spectrum of light are usually expensive, bulky or require an exotic power supply. In addition, they require frequent replacement and generate a large amount of heat, thereby affecting electrical circuitry. Each sensor has a filter to allow only a specific portion of the spectrum to pass. By combining the information from the three sensors and applying mathematical equations to the data, the color of an object can be determined.

In addition, due to variations in environment and the condition of the components, separate detectors and circuitry are required for the purpose of forming a reference point for relativity of subsequent measurements.

What all of the present bank note validators lack and what is desirable to have is the ability to quickly and accurately determine the authenticity of bank notes while keeping the cost and size of the validator to a minimum. Also lacking is the provision for compensation for variations in the environment or condition of the components using the circuiting already provided for validation determination. This long-standing but heretofore unfulfilled need for a compact and relatively inexpensive bank note validator that can quickly and accurately distinguish among authentic and counterfeit bank notes through spectral analysis is now fulfilled by the invention disclosed hereinafter.

SUMMARY OF THE INVENTION

According to the present invention a bank note validator is provided with a system for determining the color correctness of a bank note comprising four emitters, a detector, a programmable gain amplifier and processing means for controlling the operation of the system and for determining the authenticity of the bank note as a function of the light detected.

The present invention therefore reduces the complexity found in the prior art by eliminating the uneven and hot white light source and multiple spectral light detectors.

BRIEF DESCRIPTION OF THE DRAWINGS

For a more complete understanding of the nature and objects of the invention, reference should be made to the following detailed description, taken in connection with the accompanying drawings, in which.

Similar reference numerals refer to similar parts throughout the several views of the drawings.

DESCRIPTION OF PREFERRED EMBODIMENTS

The present invention is employed as a part of equipment for handling currency and bank notes of the type shown and described in U.S. Pat. Nos. 4,884,671; 5,259,490; 5,322,275; 5,527,031, and 5,630,755; all assigned to the assignee of the present application. The contents of the foregoing patents and applications are incorporated herein as if more fully set forth.

Generally, in these devices, the bank note is received and conveyed in flat condition through a validation section in which the means are provided for sensing such characteristics of the bank note, as its size, continuity, print arrangement and attribute of validity contained in or on the bank note. Similarly, the system for determining the color correctness of the bank note according to the present invention is situated at this validator section.

Figure 1:
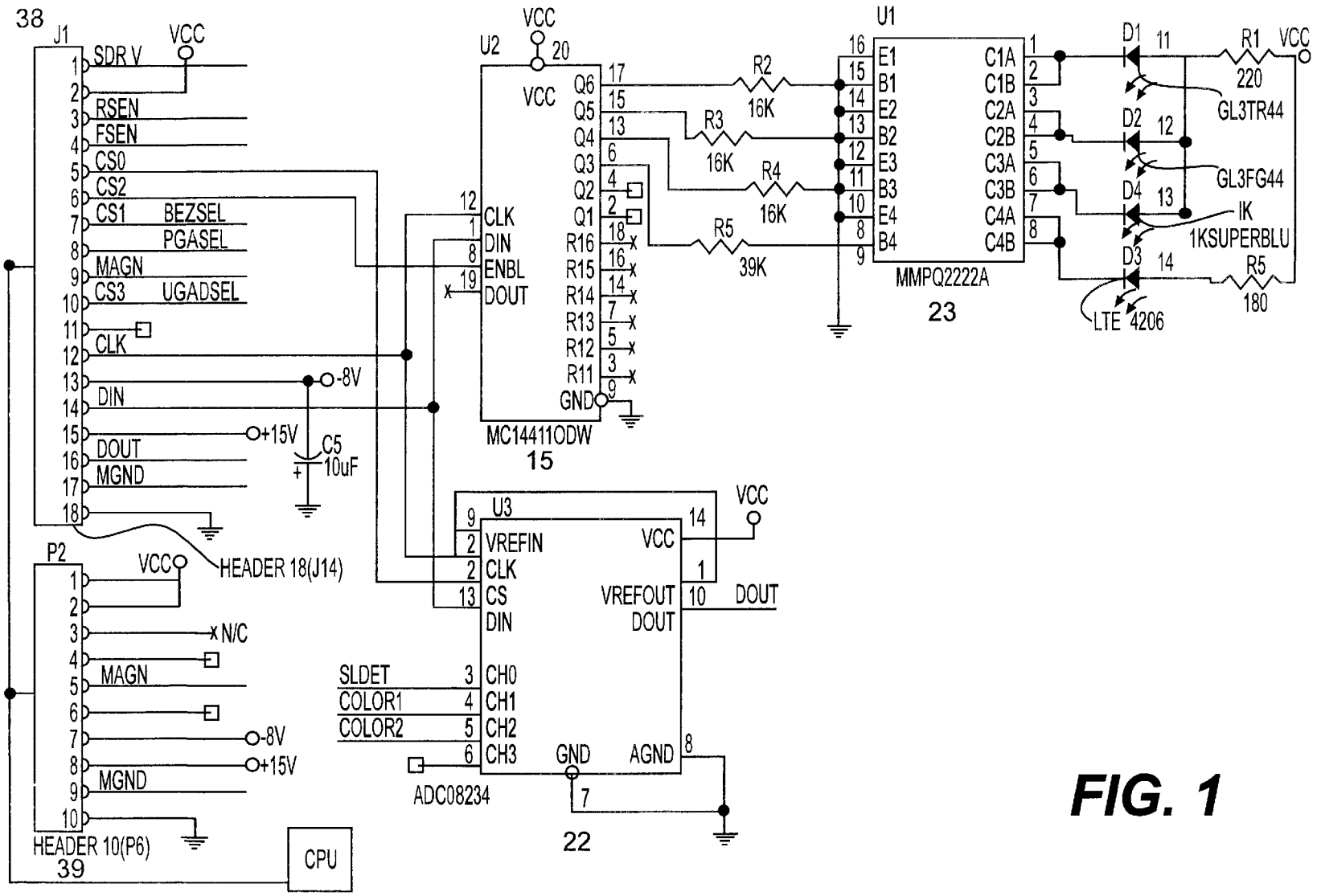
FIG. 1 is the circuit diagram of the LED control circuit of the present invention.

As seen in FIG. 1 an array of selected visible light emitting diodes (LED's), including Red LED 11, Green LED 12, Blue LED 13, and a non-visible Infrared (I/R) LED 14, is arranged, to illuminate the upper surface of the bank note on the conveyor (not shown). Each LED is driven by a transistor in a transistor array 23 which is in communication with a digital to analog (D/A) converter 15. D/A converter 15 is interfaced through headers 38, 39 to a microprocessor CPU which generates commands for selecting the sequence of operation of the LED's and adjusting the brightness of each LED. As will be described hereinafter, an analog to digital (A/D) converter 22, receives the signal output from a detector 16 which is indicative of the color sensed by the selected LED 11–14. A/D converter 22 is also connected to the microprocessor CPU where the sensed data is stored and/or processed. Interfacing to the microprocessor is provided by interfaces 38 and 39.

The LED's 11–14 are so mounted that the light emitted from each of them is concentrated upon a single point or small area where the light is sensed by photodiode detector 16, either as reflected from the surface of the bank note or as transmissive light passing through the bank note. The light sensed by the detector 16 is converted into a voltage and is simultaneously amplified by amplifier 17 and filtered by capacitor circuit 18 to reduce noise from external sources. Amplifier 17 is a low offset voltage type to reduce error due to the high gain of the overall circuit. Output from this stage is input to a programmable gain stage for modification of the signal by the microprocessor CPU. The programmable gain stage comprises a D/A converter 19 and an amplifier 20. The amplified and filtered signal from detector 16 is fed to the feedback pin of the converter 19. The converter 19 also receives data, clock and selection control signals from the microprocessor CPU via the interfaces 38 and 39 so that in conjunction with the second amplifier 20, the output from the programmable gain stage is adjusted to be identical for each selected wavelength of the reflected or transmitted light.

When a bank note containing different colors is presented to the system and selectively illuminated by the LED's, the light sensed by the detector 16 at the end of the programmable gain stage will be proportional to the corresponding color set within the CPU. A final amplifier stage 21 inverts, buffers and performs a low pass filter function (cutoff about 1 Khz) to reduce noise and prevent aliasing at A/D converter 22. The signal output from amplifier stage 21 is fed to the A/D converter 22 (FIG. 1), where it is converted to a digital signal which is fed to the microprocessor CPU via interfaces 38 and 39 for storage and processing. Thus, it is seen that the microprocessor controls the selection and adjustment of LED's 11, 12, 13, and 14, as well as the adjustment, setting, and storage of the gain settings and validation determination from the detected light signals.

In operation, the first step is to adjust the brightness of the LED's 11–14 by detecting light from a special multicolor card. An algorithm in the microprocessor CPU is used to adjust and store the LED brightness settings. The next step is to set and store in the microprocessor CPU reference gains for each of the LED's 11–14. The reference gain is set by detecting the light, adjusting the gain of the programmable gain stage so that the output from the final amplifier stage reaches a predetermined level. The gain set for each LED is stored in the microprocessor CPU as the reference gain for that LED.

The next step is to test a bank note. The bank note is placed on the conveyor and illuminated by a selected and adjusted LED and the gain is set to the reference gain for that LED. The bank note passes through the same procedures as previously noted. The reflected or transmitted light is sensed by detector 16, which outputs a signal. The signal is filtered and amplified according to the gain set. The output from amplifier stage 21 is converted to a digital signal by A/D converter 22, which is in communication with the microprocessor CPU. The value of this signal is then stored by the microprocessor CPU for later processing and comparison to data from a valid bank note. A sample is taken with respect to Red, Green, Blue and I/R light and entered into the microprocessor CPU for a full validation determination. If the microprocessor CPU determines the bank note is valid then the note is accepted; if not it is rejected in the manner shown in the aforementioned patents.

As mentioned previously, the present invention allows the use of either reflective or transmissive light to be detected. The detector 16 can be used in a position to detect reflected or transmitted light or more than one detector can be used such that both transmissive and reflective modes are used. Reference gains are set and LED adjustments made in order to compensate for the change in brightness of LED's due to temperature changes. In the present invention, the same detector 16 is used for sampling a bank note for validation determination as well as for the monitoring of LED's 11–14 for adjustment and compensation purposes. This reduces the number of components and the associated circuitry.

Validators are used in various environments from the Sahara Desert to Greenland for vending application. Temperature extremes of −25° C. to +50° C. are not unknown. Each LED's light output for a given current is proportional to temperature so that as the temperature increases, light output decreases and vice versa. In addition, LED's made from different processes respond differently to temperature in varying degrees. Suffice it to say, the Red, Green, and Blue devices behave very differently from each other with temperature variation. The circuitry which drives the emitters is also subject to performance variations with temperature. As an example, the gain of transistors will increase approximately 1% per degree Centigrade. This would allow more current flow, thereby increasing the brightness of the device for a given setting. Compensation for temperature change in the present invention may be practiced with a clear conveyor on which the LED's are impinged with light to permit calibration and references of the computer. It may be helpful, however, to use a backdrop such as white paper since the response to white paper will remain fairly constant in any given environment, however, a machine adjusted to work in New York in September will not function in the Sahara or in Greenland in September or any other season.

Reflective compensation is effected by using a backdrop such as the white paper, the brightness of the LED's is adjusted to provide a light output between 50% and 75% of full power. This provides enough adjustment capability for any degradation of output due to component aging or temperature effects in the machine. Readings are taken of the Red, Green, Blue and Infrared sources reflectively. The process continues by adjusting the gain setting for each color until a predetermined level is reached for each color. This level provides the basis for the color detection. Since the infrared part of the spectrum is not used in color detection, the level for the infrared may or may not match the Red, Green, and Blue levels. Once the reflective gains have been set, the gain adjustment and the setting for the LED adjustment are stored in a permanent area of the microprocessor CPU memory as the reflective reference gains.

Transmissive compensation is effected by removing the backdrop paper until an unobstructed path is provided between the LED's and the transmissive deflector. The microprocessor CPU then adjusts the gain of the programmable gain stage for each color until a permanent level is achieved. These values are stored in a permanent area of the microprocessor CPU memory as transmissive reference gains.

As the validator waits for a bill to be inserted, the microprocessor CPU monitors the LED's and modifies the gains to maintain them identical with the stored readings. This maintains the balance over the expected temperature variations.

To adjust the LED brightness, a special card is inserted. This card has white, black, red, green, and blue regions on it. As each different area passes under the sensor, the relative strengths of the responses are measured. An algorithm in the microprocessor CPU then adjusts the settings of D/A converter 15 for each LED to achieve the proper balance.

Once the LED's 11–14 have been adjusted and the reference gains determined and set a bank note is submitted for validity testing. As described in previous patents, upon a positive validity determination by the microprocessor CPU, the bank note is passed on to a secure storage area, where it cannot be retrieved, and credit or services for receipt of the bank note are rendered. If an invalid determination is made, the bill is immediately rejected.

Another embodiment would employ separate amplifiers 17, 20, 21 and their associated circuitry for each LED wavelength. While comprising more parts, the gains for each channel could be set during manufacture precluding need for adjustment in the field.

Figure 2:
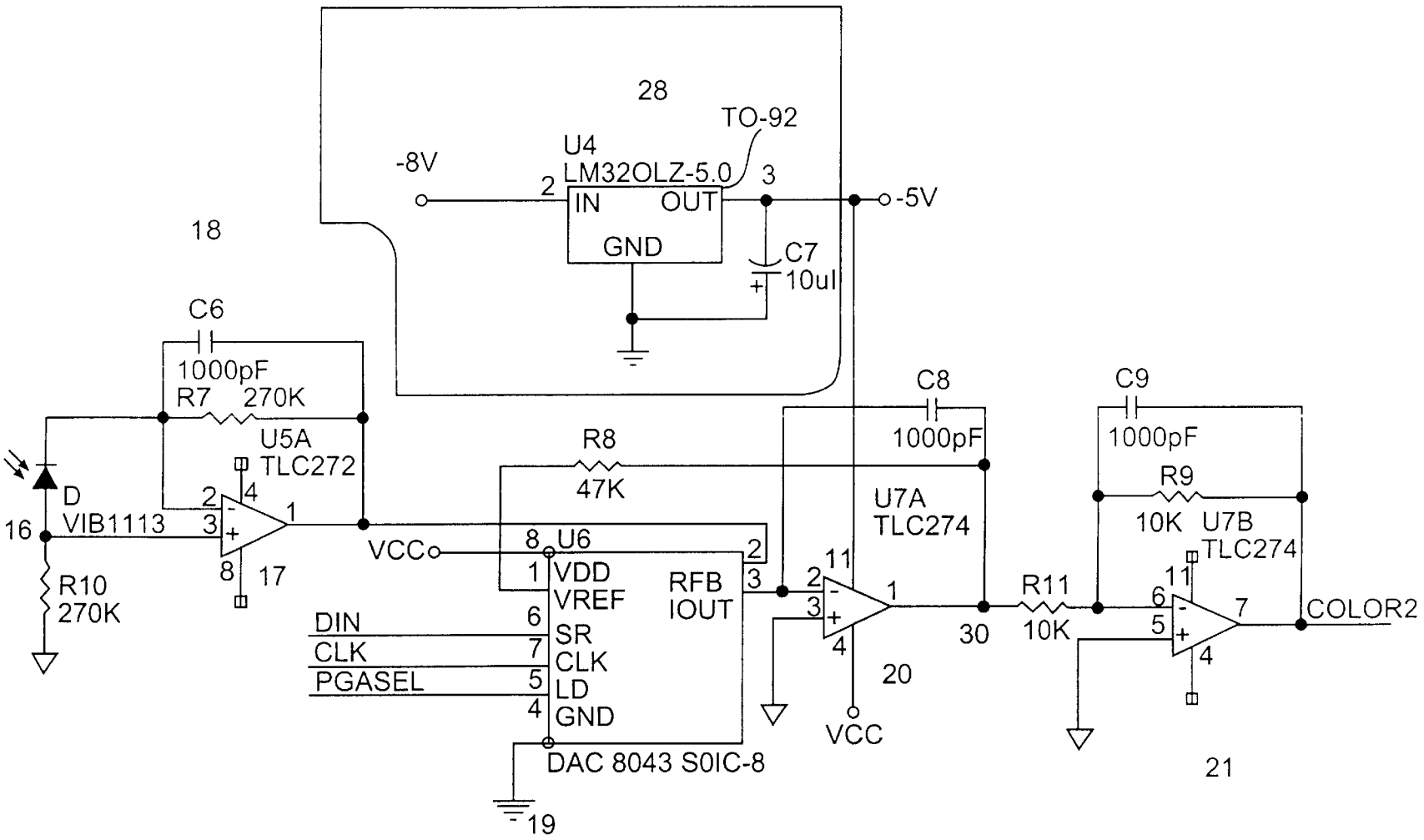
FIG. 2 is the circuit diagram of the detector and amplifier circuit portion of the present invention.

The arrangement shown in FIG. 2, where the color output is controlled and balanced by the microprocessor CPU through a single amplifier/gain circuit is preferred. This arrangement eliminates separate amplifiers for each color, reducing the number of parts required, and improves linearity of the system.

It shall be noted that all of the above description and accompanying drawings of the invention are to be considered illustrative and are not to be considered in the limiting sense.

It is also understood that the following claims are intended to cover all of the generic and specific embodiments and features of the invention herein described.

What is claimed is:

1. In a bank note validator having means for determining the validity of the bank note and for accepting and rejecting the bank note, a system for determining the color correctness of said bank note comprising, means for selectively supplying a red, green, blue, and infrared light to said bank note, a detector for selectively sensing reflective and transmissive light emitted from and passing through said bank note, gain stage means for selectively limiting an output signal indicative of the color of the light sensed by said detector, wherein said gain stage means comprises an amplifier and a D/A converter having a feedback pin wherein the output of said detector is fed to the feedback pin of the D/A converter and the D/A converter is interfaced to a microprocessing means for programmably controlling the gain setting of the amplifier, microprocessor means for adjusting, setting, and storing a gain of said gain stage means, for selectively activating said red, green, blue, or infrared lights and for determining the validity of the bank note, and converter means for providing said output signal to the microprocessor means.

2. The system according to claim 1, including means interposed between said detector and said gain stage means for amplifying and filtering the signal output by the detector.

3. The system according to claim 1, wherein the intensity of said supplied light is controlled by said microprocessor means.

4. The system according to claim 1, wherein an amplifier stage means is interposed between said gain stage means and said converter means for inverting, buffering and filtering the output signal before it is provided to the converter means.

5. The system according to claim 1, wherein the means for selectively supplying a red, green, blue and infrared light comprises a transistor array controlled by the microprocessor having a transistor for driving each of a red, green, blue, and infrared light emitting diode such that the intensity of the light supplied is controlled by the microprocessor means.

6. The system according to claim 1, wherein the converter means for providing the output signal gain stage means to the microprocessor means comprises an A/D converter.

7. The system according to claim 1, wherein the detector detects light reflected from the bank note.

8. The system according to claim 1, wherein the detector detects light transmitted from the bank note.

9. The system according to claim 1, wherein the bank note is replaced with a white paper, the detector detects the red, green and blue light respectively reflected from the white paper, the microprocessor means adjusts and stores the gain of said gain stage means for each light color supplied to form a reference gain such that a predetermined level is met for each output signal and wherein the gain is preset with the reference gain stored for each light color supplied before submitting a bank note for color correctness determination.

10. The system according to claim 1, wherein the bank note is replaced with a white paper, the detector detects the red, green and blue light respectively transmitted from the white paper, the microprocessor means adjusts and stores the gain of said gain stage means for each light color supplied to form a reference gain such that a predetermined level is met for each output signal and wherein the gain is preset with the reference gain stored for each light color supplied before submitting a bank note for color correctness determination.

11. The system according to claim 1, wherein the bank note is replaced by a card with white, black, red, green and blue regions on it, the detector detects light from the card, and the microprocessor means adjusts the intensity of the light emitted for each light color.

* * * * *